United States Patent [19]

Endo et al.

[11] Patent Number: 5,045,222

[45] Date of Patent: Sep. 3, 1991

[54] USE OF TRIACYLATED ETHANOLAMINES AS LIQUID, WATER-MISCIBLE PEROXIDE ACTIVATORS

[75] Inventors: Hajime Endo, Chiba, Japan; Hanspeter Gethöffer, Frankfurt am Main, Fed. Rep. of Germany; Fritz-Feo Grabley, Köigstein/Taunus, Fed. Rep. of Germany; Gerd Reinhardt, Kelkheim/Taunus, Fed. Rep. of Germany

[73] Assignee: Hoechst Aktiengesellschaft, Frankfurt am Main, Fed. Rep. of Germany

[21] Appl. No.: 449,990

[22] Filed: Dec. 13, 1989

[30] Foreign Application Priority Data

Dec. 14, 1988 [DE] Fed. Rep. of Germany ..... 3842008

[51] Int. Cl.[5] ..... C11D 7/54; C11D 3/395; C11D 9/30; C11D 1/18

[52] U.S. Cl. ..... 252/102; 252/94; 252/95; 252/117; 252/541; 252/544; 252/174.21; 252/174.22; 252/DIG. 14

[58] Field of Search ..... 252/95, 99, 102, 186.25, 252/186.38, 106, 544, 174.21, 174.22, 541, 117

[56] References Cited

U.S. PATENT DOCUMENTS

| | | | |
|---|---|---|---|
| 4,207,199 | 6/1980 | Perner et al. | 252/186.25 |
| 4,541,944 | 9/1985 | Sanderson | 252/95 |
| 4,772,412 | 9/1988 | Green et al. | 252/96 |
| 4,772,413 | 9/1988 | Massaux et al. | 252/102 |
| 4,786,431 | 11/1988 | Broze et al. | 252/99 |

FOREIGN PATENT DOCUMENTS

| | | |
|---|---|---|
| 1162967 | 2/1964 | Fed. Rep. of Germany . |
| 3519689 | 12/1986 | Fed. Rep. of Germany . |

*Primary Examiner*—Paul Lieberman
*Assistant Examiner*—Kevin D. McCarthy

[57] ABSTRACT

Use of triacylated ethanolamines as liquid, water-miscible peroxide activators

Triacylated ethanolamines of the formula $$(RCO)(R_1CO)N\text{-}(CH_2)_2\text{-}OCOR_2$$

where R, $R_1$ and $R_2$, which may be identical to or different from one another, are each alkyl, alkenyl or aryl, and the total number of carbon atoms in the molecule is from 8 to 14, are liquid and readily water-miscible. Owing to these properties, they are very useful as peroxide activators in liquid detergent compositions.

6 Claims, No Drawings

USE OF TRIACYLATED ETHANOLAMINES AS LIQUID, WATER-MISCIBLE PEROXIDE ACTIVATORS

DESCRIPTION

Inorganic persalts have long been known for use as bleach additives in detergent compositions. Since, however, they only develop their maximum bleaching power at temperatures above 60° C., they are formulated together with activators, organic compounds which react with hydrogen peroxide during the wash to release a peroxycarboxylic acid. This peroxycarboxylic acid has a bleaching and disinfecting action at as low as 40°-60° C. A survey of numerous known activators such as N-acyl compounds (tetraacetylethylenediamine (TAED), tetraacetylmethylenediamine, tetraacetylglycoluril (TAGU), and activated esters (pentaacetylglucose (PAG), sodium acetoxybenzenesulfonate, sodium nonanoyloxybenzenesulfonate (NOBS), sodium benzoyloxybenzenesulfonate (BOBS)) is given for example in U.S. Pat. No. 4,248,928. These activators (in particular TAED, TAGU, PAG and NOBS) are predominantly used in washing powders. However, a disadvantage of many potential activators is their low water solubility at very low wash temperatures (10°-20° C.). Without agitation, activator crystals settle out from the washing liquor on the fabric being washed, forming bleach spots thereon. It would be of advantage here to use a completely water-soluble activator.

Recently, there has been a trend toward using liquid heavy duty detergent compositions. However, a disadvantage of existing heavy duty liquid detergent compositions is the absence of a bleaching system for removing stubborn, oxidizable stains.

A number of patent applications therefore propose aqueous bleaching systems based on hydrogen peroxide and an activator, which are stored at <pH 7 and are not combined with the surfactant mixture until shortly before the start of the wash, since this is the only way of ensuring stable storage.

In addition, DE 351,151, EP 217,454 and EP 225,654 describe water-free liquid heavy duty detergent compositions which besides a surfactant mixture, auxiliaries and builders also contain a bleaching system of the activator/persalt type, including dispersions of finely ground perborate monohydrate and TAED. DE 3,728,256, DE 3,729,074 and EP 125,781 draw attention to the advantages of incorporating liquid, organic activators (for example acylals and diacetylmethylamine). However, the claimed activators (for example ethylidene acetate benzoate) have the disadvantage of limited solubility in water, of being usable in water-containing formulations only as suspensions, and of dissolving only slowly in the course of the bleaching process. It must be considered a further disadvantage that perhydrolysis is followed by the formation of degradation products (low molecular weight aldehydes, N-methylacetamide) which must partly be considered environmentally problematical.

The use of liquid activators, including inter alia triacetylethanolamine, adsorbed on inorganic carrier materials, in washing powders is described in DE-A-2,733,849.

There continues to be immense interest in storable bleach activators which are readily water-soluble, which may also be readily incorporable in water-containing or water-free bleaching systems for liquid detergent and disinfectant compositions, and which rapidly release an oxidizing and disinfecting peracid.

It has now been found, surprisingly, that triacylated ethanolamines are very readily water-miscible and, in the presence of hydrogen peroxide or other percompounds, release one mole of a peracid even at room temperature.

The present invention accordingly provides for the use of a triacylated ethanolamine of the general formula $$(RCO)(R_1CO)N—(CH_2)_2—O—COR_2$$

where R, $R_1$ and $R_2$, which may be identical to or different from one another, are each alkyl, alkenyl or aryl, and the total number of carbon atoms in the molecule is from 8 to 14, as a liquid, water-miscible peroxide activator in liquid detergent compositions.

Triacylated ethanolamines are known compounds with a known textile treatment effect (U.S. Pat. No. 2,143,765). They are prepared by reacting ethanolamine with an excess of a carboxylic anhydride or carbonyl halide at elevated temperature. However, for economic and ecological reasons they are preferably prepared by the two-stage method described hereinafter.

First, ethanolamine is reacted with an acid at temperatures between 120° and 200° C. to give carboxylic monoethanolamide or an N,O-diacylethanolamine by elimination of water. The product is reacted in a second step, without further purification, with a carboxylic anhydride at from 130° to 170° C. to give a carboxylic acid, which is distilled off. The reaction may be carried out in the presence of an acidic or basic catalyst such as sulfuric acid, p-toluenesulfonic acid or sodium acetate and under reduced pressure. The carboxylic acid formed in this second reaction step can be fed into the first reaction step for a continuous process, if desired.

The water solubility of the acylation products obtained in this manner strongly depends on the number of carbon atoms present. Preferred compounds are triacetylethanolamine, diacetylpropionylethanolamine, tripropionylethanolamine and benzoyldiacetylethanolamine, of which triacetylethanolamine has the best water solubility and is miscible with water in any proportion. Compounds of more than 14 carbon atoms do not have any advantage over existing solid activators, since they need to be emulsified or dispersed because they are not soluble enough.

Triacetylethanolamine (TAEA) readily reacts in aqueous solution with hydrogen peroxide or inorganic persalts to form peracetic acid, a powerful bleach and disinfectant. The inorganic persalts used can be perborates, percarbonates, persulfates or perphosphates in the form of their sodium or potassium salts. The molar ratio of persalt: activator is from 0.5:1 to 10:1, preferably from 1:1 to 4:1.

By dissolving the triacylated ethanolamine in an anhydrous nonionic surfactant and adding the finely ground persalt it is possible to obtain a stable bleach mix which can be used directly or combined with other additives for washing, cleaning or disinfecting. Further possible ingredients for the mixture are anionic or cationic surfactants, enzymes, peroxide stabilizers, antigelling agents, scents and dyes. A combination with other peroxide activators or peroxycarboxylic acids such as dodecanediperoxycarboxylic acid is possible. A further possible use of the compounds described is as peroxide activators in a pulverulent detergent composition. For this purpose, the liquid activator is adsorbed on a solid, such as a zeolite or sodium perborate, and optionally stabilized by additional granulation or coating.

The present invention relies on the newly discovered fact that the triacylated ethanolamines described are fully miscible with water. Owing to this property, the peroxide activator is completely homogeneously dispersible in liquid detergent compositions and in particular in the washing liquor, thereby avoiding the disadvantages, such as bleach spots, resulting from the inhomogeneous dispersion of solid peroxide activators in such detergent compositions.

EXAMPLE 1

Preparation of triacetylethanolamine 120.2 g (2 mol) of glacial acetic acid are added dropwise to 122 g (2 mol) of ethanolamine, and the water formed is distilled off. After cooling, 1 g of p-toluenesulfonic acid is added, followed by a further 60.1 g (1 mol) of glacial acetic acid, again added dropwise. After 3 hours of refluxing, more water is distilled off. 2 g of sodium acetate are added, followed by 306.3 g (3 mol) of acetic anhydride, added dropwise, and the resulting acetic acid is distilled off. The product is then distilled under an oil pump vacuum through a 20 cm Vigreux column.

Yield: 280.1 g (75%) of a clear liquid $n_D = 1.4515$ (25° C.)

300 MHz 1H-NMR spectrum in CDC13: delta 2.07 ppm (s 3H)

2.43 ppm (s, 6H)

3.94 ppm (t, 2H)

4.22 ppm (t, 2H)

Determination of the Water Solubility of Activators

The water solubility of N,N,O-triacetylethanolamine (TAEA) and ethylidene benzoate acetate (EBA) was determined by known methods.

| Activator | Water solubility 23° C. | 37° C. |
|---|---|---|
| TAEA | ∞ | ∞ |
| EBA | 0.7 g/l | 0.8 g/l |

Determination of Perhydrolysis Rate of Dissolved Activator

The experimental determination of the perhydrolysis rate of the activators TAEA (triacetylethanolamine), TAED (tetraacetylethylenediamine) and isonobs (sodium isononanoyloxybenzenesulfonate) was carried out under wash conditions in a 2 l beaker in a thermostat. An electrical stirrer ensured uniform stirring of a 2 percent strength solution of an IEC standard detergent composition, to which perborate had been added together with 20 ml of a cherry juice solution as a bleachable stain.

The activators were predissolved in a little water and added to the abovementioned temperature controlled washing liquor. At each set time interval (1-5 minutes) a 50 ml sample was removed and titrated for total active oxygen and peracid.

TABLE 1:

pH dependence of perhydrolysis of dissolved bleach activators at 22° C.; time required [min] for 90% conversion of activator:

| | pH 9 | pH 10 | pH 11 |
|---|---|---|---|
| TAEA | 12 min | 7 min | 1 min |
| TAED | 15 min | 7 min | 1 min |
| Isonobs | >30 min | 11 min | 1.5 min |

These results show that TAEA releases one mole of peracetic acid very rapidly, in fact as rapidly as predissolved TAED. These perhydrolysis rates are higher than the rate of formation of perisononanoic acid from isonobs.

Wash Tests in Launder-O-meter at 60° C.

These tests were carried out at 60° C. in water of 15° German hardness in a Launder-O-meter using standard soil cloths WFK 10 G cotton (tea stain) and EMPA cotton No. 114 (red wine stain). The bleaching systems perborate) were added in such amounts that in each case 25 mg of active oxygen were present per liter of washing liquor. The detergent used in each case was 1.5 g of IEC basic washing powder per liter of washing liquor. The washing time was 30 minutes. The bleaching effect was determined as the increase in the reflectance of the various test fabrics. The measurements were processed in the usual manner.

| Bleaching system | Reflectance values Tea | Red wine |
|---|---|---|
| TAEA/PB | 70.9 | 66.7 |
| EDA/PB | 69.9 | 64.9 |
| DALEA/PB | 64.0 | 57.9 |
| PB | 62.9 | 58.0 |

TAEA N,N,O-triacetylethanolamine
EDA Ethylidene diacetate
DALEA N,O-diacetyl-N-lauroylethanolamine
PB sodium perborate The washing tests show that TAEA is superior in bleaching performance to previously known EDA and to non-liquid DALEA.

Washing Tests in Launder-O-meter at Room Temperature

The following tests were carried out at 25° C. in water of 15° German hardness in a Launder-O-meter using standard soil cloths WFK 10 G cotton (tea stain) and EMPA cotton No. 114 (red wine stain) and the IEC basic washing powder. The detergent composition contained in each case 3% of the activator and 10% of sodium perborate. The washing time was 15 minutes.

| Bleaching system | Reflectance Tea | Red wine |
|---|---|---|
| TAEA/PB | 56.0 | 54.9 |
| TAED/PB | 54.8 | 51.5 |
| PB | 52.8 | 51.7 |

TAEA N,N,O-triacetylethanolamine
TAED tetraacetylethylenediamine
PB sodium perborate The superior bleaching effect of TAEA under the above-mentioned wash conditions can be ascribed to the complete miscibility of the compound with water.

We claim:

1. A stable liquid bleaching or disinfecting composition comprising:

a. a finely-divided inorganic persalt, b. a liquid anhydrous nonionic surfactant, and c. dissolved in said liquid anhydrous nonionic surfactant as a liquid essentially water-soluble activator for said inorganic persalt, a triacylated ethanolamine of the formula $$(RCO)(R_1CO)N—CH_2CH_2OCOR_2$$

where R, $R_1$ and $R_2$, which may be identical to or different form each other, are each alkyl, alkenyl, or aryl, and the total number of carbon atoms in said triacylated ethanolamine is from 8 to 14, the molar ratio of said persalt to said triacylated ethanolamine being in the range of from 0.5:1 to 10:1.

2. The bleaching or disinfecting composition of claim 1, wherein the inorganic persalt is a perborate, a percarbonate, a persulfate or a perphosphate.

3. The bleaching or disinfecting composition of claim 2, wherein the inorganic persalt is a sodium or potassium salt.

4. The bleaching or disinfecting composition of claim 1, wherein the molar ratio of persalt to triacylated ethanolamine is from 1:1 to 4:1.

5. The bleaching or disinfecting composition of claim 1, wherein said triacylated ethanolamine is triacetylethanolamine, diacetylpropionyl-ethanolamine, tripropionylethanolamine, benzoyldiacetylethanolamine, or a mixture thereof.

6. The bleaching or disinfecting composition of claim 1, wherein said triacetlyated ethanolamine is N,N,O-triacetylethanolamine.

* * * * *